US011825875B2

(12) United States Patent
Lafler, Jr. et al.

(10) Patent No.: US 11,825,875 B2
(45) Date of Patent: Nov. 28, 2023

(54) CONTAINER FOR ELONGATED OR SMALL OBJECTS

(71) Applicant: Green World Products, LLC, Vicksburg, MI (US)

(72) Inventors: Richard Gene Lafler, Jr., Fulton, MI (US); Michael Richard Shane Vandenbosch, Vicksburg, MI (US); Matthew John Wheelright, Kalamazoo, MI (US); Steve Allen Shoemaker, Portage, MI (US); Kevin William Murphy, Schoolcraft, MI (US)

(73) Assignee: GREEN WORLD PRODUCTS, LLC, Vicksburg, MI (US)

( * ) Notice: Subject to any disclaimer, the term of this patent is extended or adjusted under 35 U.S.C. 154(b) by 0 days.

(21) Appl. No.: 17/736,636

(22) Filed: May 4, 2022

(65) Prior Publication Data

US 2022/0354163 A1 Nov. 10, 2022

Related U.S. Application Data

(60) Provisional application No. 63/184,480, filed on May 5, 2021.

(51) Int. Cl.
*A24F 15/00* (2020.01)
*A24F 15/12* (2006.01)

(52) U.S. Cl.
CPC ..... *A24F 15/12* (2013.01)

(58) Field of Classification Search
CPC ..... B65D 85/10; B65D 85/20; B65D 43/16; B65D 43/22; B65D 43/163; B65D 25/04;
(Continued)

(56) References Cited

U.S. PATENT DOCUMENTS 1,163,183 A 12/1915 Stoll
1,615,545 A 1/1927 Larson et al.
(Continued)

FOREIGN PATENT DOCUMENTS

CN 105495697 A 4/2016
EP 1240836 A1 9/2002
FR 399434 6/1909

OTHER PUBLICATIONS

Web pages including photos of Pre-roll Box by Dragon Chewer, publicly available prior to the filing date of the invention (6 pages).

*Primary Examiner* — King M Chu
(74) *Attorney, Agent, or Firm* — FLYNN THIEL, P.C.

(57) ABSTRACT

A container for storing and transporting elongated objects, such as smoker's articles, or other small objects, which container has a container lid or closure and a container receptacle. The container lid is mounted on the receptacle for pivoting movement relative thereto and is openable to provide full access to the interior of the container and the object stored therein, and is closable to prevent access thereto. The container incorporates a child-resistant opening mechanism, and a seal which cooperates between the container lid and the receptacle in the closed position of the container lid to prevent odors from escaping the container interior, to preserve freshness of objects stored in the interior of the container and/or to seal the container interior from moisture or other contaminants.

18 Claims, 7 Drawing Sheets

(58) Field of Classification Search
CPC ..... B65D 2215/02; A24F 15/12; A24F 15/18; A24F 15/01; A24F 15/20; A24F 15/00; A24F 40/95
USPC ..... 220/326, 263; 131/187, 178; 206/266
See application file for complete search history.

(56) References Cited

U.S. PATENT DOCUMENTS

| | | | | |
|---|---|---|---|---|
| 1,807,936 | A | 6/1931 | Saunders | |
| 2,411,946 | A | 12/1946 | Vogel | |
| 2,649,194 | A | 8/1953 | Babbitt | |
| 4,538,751 | A | 9/1985 | Peterson | |
| 6,446,793 | B1 * | 9/2002 | Layshock | A24F 15/18 206/86 |
| 7,021,318 | B2 | 4/2006 | Byun | |
| D683,898 | S | 6/2013 | Liu | |
| 8,910,783 | B2 | 12/2014 | Liu | |
| D720,884 | S | 1/2015 | Iu | |
| 9,302,825 | B2 | 4/2016 | Liu | |
| 9,352,889 | B2 | 5/2016 | Giraud et al. | |
| 10,414,553 | B2 | 9/2019 | Ziering et al. | |
| 10,435,201 | B2 | 10/2019 | Hopps et al. | |
| 10,561,173 | B2 | 2/2020 | Liu | |
| 10,624,430 | B1 * | 4/2020 | Godwin, III | A24F 15/12 |
| 10,773,862 | B2 | 9/2020 | Ziering et al. | |
| 2010/0051496 | A1 | 3/2010 | Watson | |
| 2020/0385183 | A1 | 12/2020 | Ziering et al. | |

* cited by examiner

CONTAINER FOR ELONGATED OR SMALL OBJECTS

CROSS REFERENCE TO RELATED APPLICATION

This claims priority of U.S. Provisional Application No. 63/184,480, filed May 5, 2021, the disclosure of which is hereby incorporated by reference in its entirety.

TECHNICAL FIELD

This invention relates to a container or case usable to store, transport and/or protect elongated objects, such as smoker's articles, or small objects used for medicinal and/or recreational purposes.

BACKGROUND

The term "cigarette" is commonly used to refer to a tobacco cigarette. Tobacco cigarettes typically incorporate finely-cut loose tobacco leaves wrapped in a thin paper. However, "cigarette" as used herein is intended to encompass other structurally similar products which incorporate plant products other than tobacco such as herbs or other plants, and which are used for medicinal or recreational purposes and are encased in a thin paper wrapping. In these types of products, the thin paper is rolled, by hand or with machinery, into a narrow and elongate cylindrically-shaped form for smoking. In this regard, in some locations medical and/or retail sale of marijuana products is permitted, and such products are sold in forms suitable for smoking, such as marijuana cigarettes or "pre-rolls". Marijuana products are also provided in small candy-like shapes and sizes intended for consumption by mouth, and these types of marijuana products are often referred to as "edibles".

The above-described smoker's articles, due to their thin-paper packaging, are somewhat delicate, since they can be readily crushed or otherwise damaged when handled or stored. Further, some smoker's items can also emit an odor and it is accordingly beneficial to prevent escape of this odor to the environment during transport or storage. It is also highly desirable to store the above-discussed items in a child-resistant manner so as to discourage access by children thereto.

It is therefore desirable to provide a container which stores and protects the above-described types of items, and which container is sealed and substantially airtight so as to prevent the escape of any odors emitted by the items, to preserve the freshness of the stored items and also to discourage access to such items by children.

Various types of containers are available for storing elongated objects, such as the cigarettes described above. An example of one such container includes a lid or cover hingedly attached to a lower case in which product is housed. This known container incorporates a locking feature which requires the user to press opposite upright sides of the lower case in order to release the lid. However, this container does not function to seal the product to prevent odors from escaping or to prevent moisture and/or other contaminants from entering the interior.

In order to address the concerns associated with storing the various items discussed above, a container according to one aspect of the invention generally includes a cover or lid member and a receptacle member with a base wall and a side wall joined to and projecting outwardly from the base wall. The base wall and the side wall of the receptacle member together define at least part of a hollow interior of the container in which product is stored, which interior opens through an edge portion of the side wall of the receptacle member. The lid and receptacle members are connected to one another by a hinge arrangement which allows movement of the lid member between an open position in which the hollow interior is accessible and a closed position in which the hollow interior is inaccessible. The hinge arrangement incorporates at least one elongated recess disposed on one of the receptacle member or the lid member and at least one projection disposed on the other of the receptacle member or the lid member. The projection is engaged within the recess and slidably movable relative to and along the recess during opening and closing of the lid member. The container additionally includes a container-locking arrangement disposed to cooperate between the receptacle member and the lid member. The container-locking arrangement has a locked condition in which the lid member in maintained in its closed position to prevent access to the interior, and an unlocked condition in which the lid member is movable into its open position to permit access to objects stored within the interior. A seal component of a compressible material is fixed to the lid member and is configured to compressively engage the edge portion of the receptacle member in the closed position of the lid member to seal the interior and prevent ingress of contaminants into the interior and prevent egress of odors emanating from product stored in the interior of the container.

A container according to another aspect of the invention is for sealing and storing objects therein, and includes a lid member with a top wall and a side wall structure depending downwardly from a periphery of the top wall, wherein the top wall and the side wall structure together defining a downwardly-opening interior of the lid member. The container also includes a receptacle member having a base wall and a side wall structure projecting upwardly from a periphery of the base wall. The base wall and the side wall structure of the receptacle member together define an upwardly-opening interior of the receptacle member which opens through an upper free edge portion of the side wall structure of the receptacle member. The lid member is connected to the receptacle member for pivoting movement between an open position in which the interior of the receptacle member is accessible and a closed position in which the lid member closes off the interior of the receptacle member. Additionally, a locking mechanism is disposed to cooperate between the receptacle member and the lid member, the locking mechanism having a locked condition in which the lid member in maintained in the closed position thereof to prevent access to product stored in the interior of the receptacle member, and an unlocked condition in which the lid member is movable into the open position to permit access to product stored within the interior of the receptacle member. The locking mechanism includes at least one deflectable area disposed on the side wall structure of the receptacle member which when deflected causes release of the locking mechanism from the locked condition to permit movement of the lid member into the open position. Further, a seal component is provided and is constructed of a compressible material. The seal component is fixedly disposed within the interior of the lid member and extends around an inner periphery of a lower surface of the top wall thereof and is at least partially surrounded by the side wall structure of the lid member. The seal component is compressively engaged between the upper free edge portion of the receptacle member and the lid member in the closed position thereof, and has a portion in direct contact with the upper free edge portion of the receptacle member in the closed position of said lid member.

Figure 3:
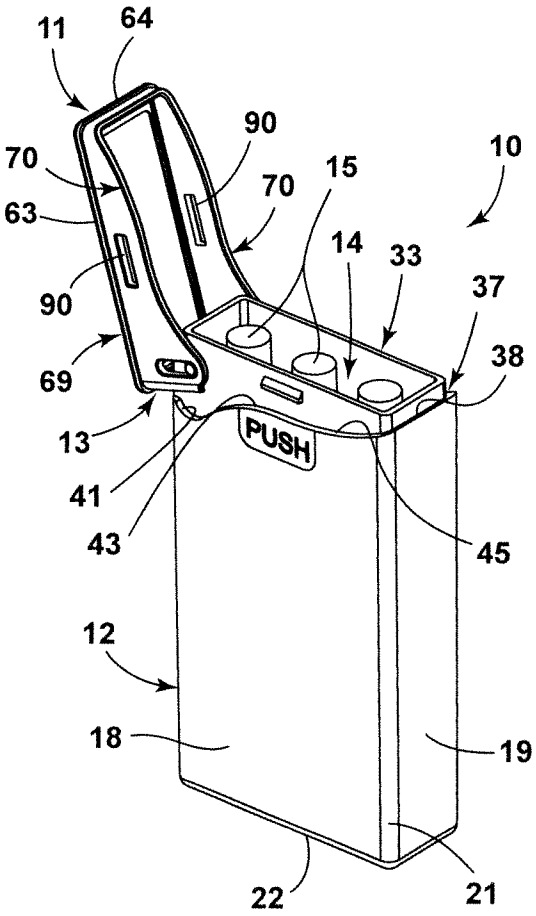
FIG. 3 illustrates the container of FIG. 1 in an open configuration.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the container and of designated parts thereof. The word "frontwardly" will refer to a part or parts of the container remote from a hinge arrangement which interconnects a container lid and a container receptacle which form part of the container, and the word "rearwardly" will refer to a part or parts of the container disposed generally adjacent the hinge arrangement. Said terminology will include the words specifically mentioned, derivatives thereof, and words of similar import.

DETAILED DESCRIPTION

Figure 2:
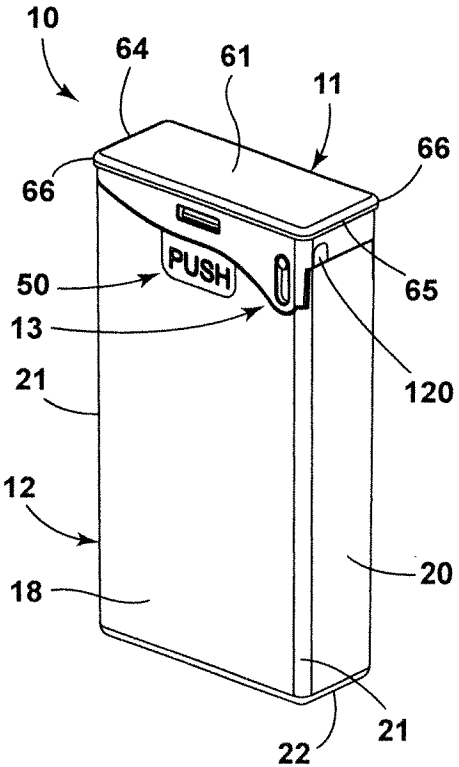
FIG. 2 is a side perspective view of the container rotated approximately 180 degrees from the position illustrated in FIG. 1.
Figure 1:
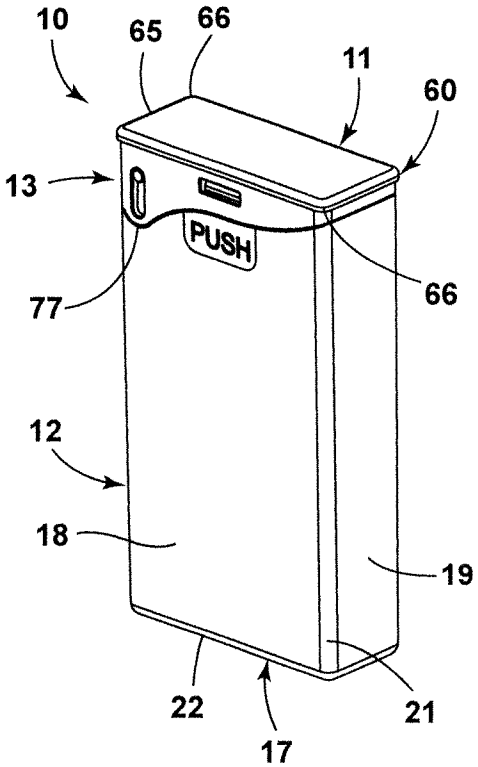
FIG. 1 is a side perspective view of a container in a closed configuration.
Figure 6:
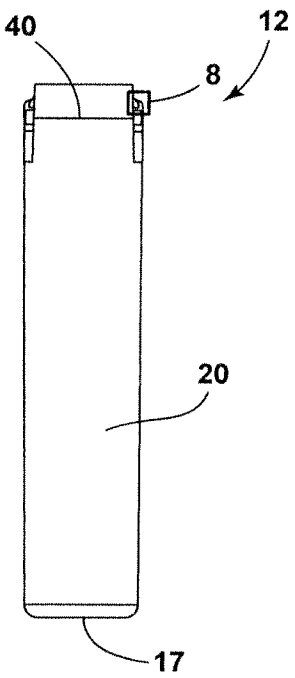
FIG. 6 is a rear view of the container receptacle of FIG. 4.

With reference to FIGS. 1-3, there is illustrated a container or case 10. The container 10 includes a container lid or cover 11, which container lid 11 forms a top component of the container 10, and a container receptacle or body 12, which container receptacle 12 forms a bottom component of the container 10. The container 10 is normally maintained in an upright position in which the container lid 11 is oriented uppermost. The container lid 11 and the container receptacle 12 together define a generally hollow interior 14 of the container 10. The container lid 11 is mounted to the container receptacle 12 by a hinge arrangement 13 such that the container lid 11 is movable towards and away from the container receptacle 12. More specifically, the container lid 11 is movably, and in the illustrated embodiment rotatably or pivotably, positionable between a closed position as shown in FIG. 1 and an open position as shown in FIG. 3. When the container lid 11 is in the closed position, the container lid 11 is seated atop the container receptacle 12 and closes off the hollow interior 14 of the container 10. A plurality of products 15, which in the illustrated embodiment are cigarettes, are stored within the hollow interior 14 in an upright or substantially vertical manner. When access to the hollow interior 14 of the container 10 is desired, the container lid 11 is moved via the hinge arrangement 13 away from the receptacle 12 into the open position so as to provide access to the interior 14 and the product or products 15 stored therein.

The container receptacle 12, as shown in isolation in FIGS. 4-7, generally includes a bottom wall 17, a pair of side walls 18 and front and rear end walls 19 and 20 which in this embodiment are all substantially rectangular and elongated in shape. In this regard, the various edges or edge portions of the receptacle walls 17-20 as used hereinafter may be referred to using the term "longitudinal", meaning an edge or edge portion having the greater dimension as compared to other edges of the wall being described which have a lesser dimension. The various walls 17-20 of the receptacle 12 are solid, substantially planar and are interconnected to one another so that they together define the lowermost part of the hollow interior 14 which opens upwardly through a top of the container receptacle 12 when same is oriented upright. Specifically, the side walls 18 are laterally-spaced from, and are substantially parallel to, one another and lower edges of the side walls 18 are respectively joined to opposite longitudinal edges of the bottom wall 17. Opposite longitudinal edges of each side wall 18, which in the normal upright position of the container 10 are oriented substantially vertically, are respectively joined to longitudinal edges of the front and rear end walls 19 and 20 which are also oriented substantially vertically. The bottom wall 17 and the front and rear end walls 19 and 20 accordingly extend transversely between and interconnect the side walls 18 to one another. The areas of intersection between each of the side walls 18 and the bottom wall 17, and between each of the side walls 18 and the front and rear end walls 19 and 20, respectively define four substantially horizontally oriented corner areas 22 of the receptacle 12 adjacent the bottom wall 17 and four substantially vertically oriented corner areas 21.

The side walls 18 and the front and rear end walls 19 and 20 terminate at respective upper edges, which upper edges together define a generally rectangular and peripherally extending upper edge 33 of the container receptacle 12 through which the interior 14 thereof opens. Adjacent this upper edge 33, the side walls 18 and the front and rear end walls 19 and 20 have respective upper edge regions which are recessed inwardly towards the interior 14 of the container 10. This inwardly recessed configuration along the side walls 18 and the front end wall 19 defines a step or edge 37 which is spaced downwardly from the upper edge 33 and extends continuously around the upper end of the container receptacle 12 along the side walls 18 and the front end wall 19 in a U-shape when viewed from above. The step 37 has a substantially linear or straight front step portion 38 which extends along the front end wall 19 between the respective side walls 18. The inwardly recessed configuration adjacent the rear end wall 20 defines a substantially linear rear step portion 40 which extends horizontally along the rear end wall 20 between the respective side walls 18. Both of the front and rear step portions 38 and 40 are substantially parallel to the upper terminal edge 33 of the receptacle 13, and the rear step portion 40 is spaced downwardly from the edge 33 a greater distance as compared to the front step portion 38. The step 37 additionally extends along each of the side walls 18, and when viewed from a position substantially perpendicular to the respective side wall 18, the step 37 has an undulating or scalloped curvature. In this regard, moving in a direction from left to right in FIG. 5 (or from a rear of the receptacle 12 to a front thereof), the step 37 has a rearwardly oriented step portion 41 disposed adjacent the hinge arrangement 13. The rear step portion 41 is downwardly convex such that the step portion 41 at its upper side has an upwardly opening generally semi-circular or arcuate configuration, and this rear step portion 41 smoothly adjoins a central step portion 43 at which the curvature of the step 37 reverses from that of the rear step portion 41 and forms an upwardly-projecting convex shape. The curvature of the step 37 then reverses again, and the step 37 along a further step portion 45 thereof gradually rises until the front step portion 45 adjoins the front step portion 38 located along the front end wall 19. It will be appreciated that the undulating configuration of the step 37 as described above is only an example of one possible configuration of the step 37, and the step 37 may instead be provided so as to extend straight or linearly along each of the side walls 18 and the end walls 19, 20, or may have other configurations.

Figure 8:
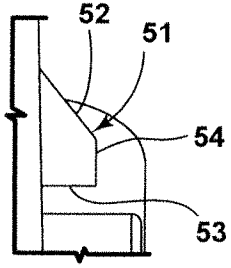
FIG. 8 is an enlarged, fragmentary detail view "8" of FIG. 6 of a detent provided on the container receptacle.
Figure 4:
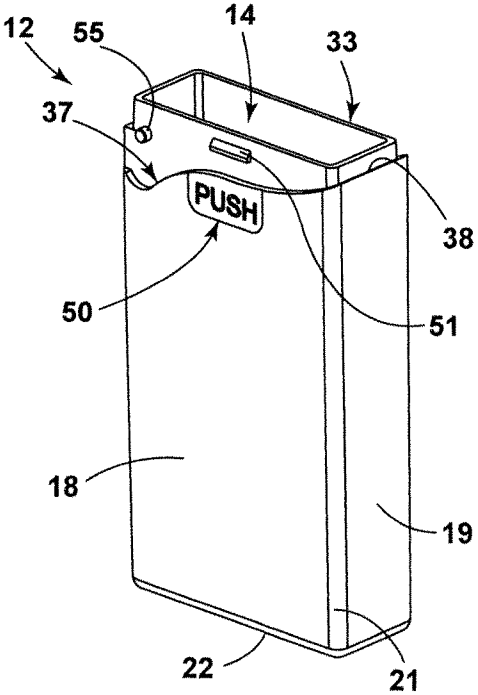
FIG. 4 is a side perspective and isolated view of a container receptacle which forms a lower part of the container of FIG. 1.

Each of the side walls 18 includes an actuation area 50 disposed substantially centrally thereon beneath the central step portion 43 of the step 37 of the respective side wall 18. The actuation area 50 includes instructional wording or indicia thereon for use by the user to aid in opening the container 10 as discussed further below. In the illustrated embodiment, the word "PUSH" is provided at each actuation area 50. Such instructional wording may be provided directly on the side walls 18 via a molding process, by stamping the side walls 18, or such wording may be provided on a label which is fixed to the side walls 18 with adhesive. Other methods of providing the instructional wording are within the scope of the invention, and the above methods are provided only as examples. The upper edge region of each side wall 18 additionally includes a detent 51 in the form of a horizontally elongate projection which extends a short distance sidewardly outwardly from the respective side wall 18. As shown in the detail view of FIG. 8, each detent 51 has an upper beveled surface 52 which angles downwardly as same projects away from the vertical surface of the respective side wall 18, a generally planar lower surface 53 and a generally planar surface 54 which extends vertically between and interconnects the beveled surface 52 and the lower surface 53. The actuation areas 50 and the detents 51 each form part of a child-resistant release mechanism.

Each of the side walls 18 further includes a hinge element, projection, post or pin 55, which pins 55 project sidewardly outwardly from the respective side walls 18. The pins 55 form part of the hinge arrangement 13 of the container 10.

Figure 5:
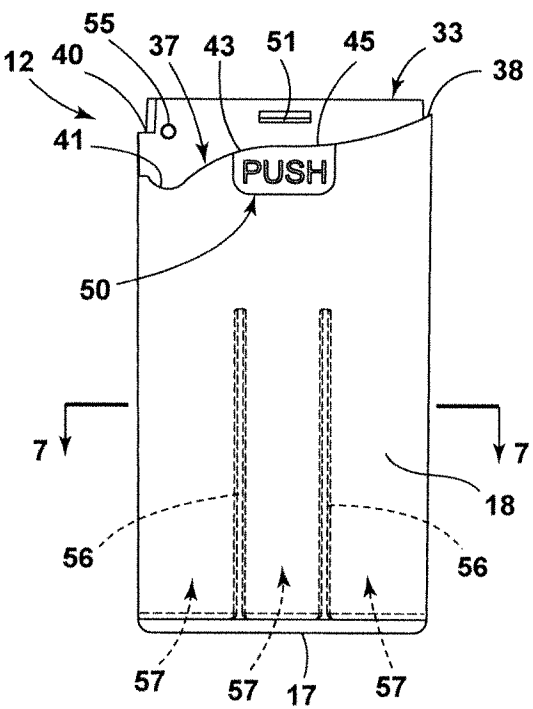
FIG. 5 is a side view of the container receptacle of FIG. 4.
Figure 7:
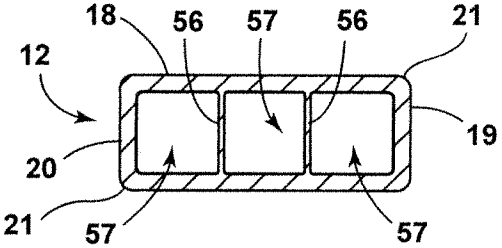
FIG. 7 is an enlarged cross-sectional view of the container receptacle taken generally along line 7-7 in FIG. 5.
Figure 10:
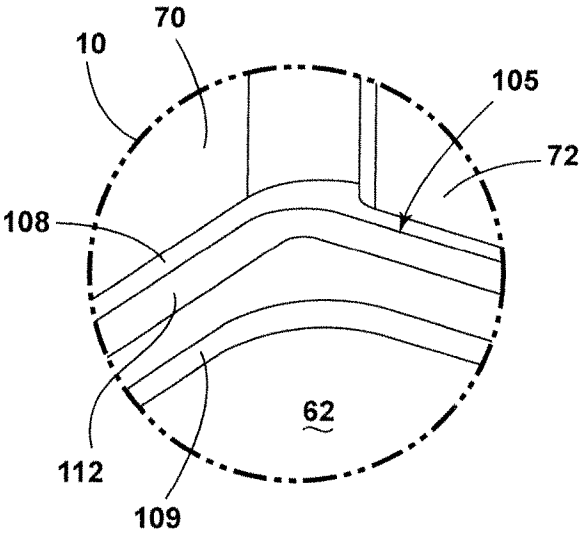
FIG. 10 is an enlarged detail view "10" of FIG. 9 of a portion of the underside of the container lid.

As best shown in FIGS. 5 and 7, the container receptacle 12 incorporates a plurality, and here two, of divider walls 56 which are positioned within the interior thereof so as to be substantially parallel to the front and rear end walls 19 and 20. Each divider wall 56 is generally planar and vertically oriented and extends between and adjoins inner opposed surfaces of the laterally-spaced side walls 18. The lower edge of each divider wall 56 is additionally joined to an inner and upwardly-facing surface of the bottom wall 17 of the receptacle 12. The divider walls 56 are positioned within the receptacle 12 so as to divide same into three compartments 57 of substantially equal size, each for storing a product 15 therein in an upright manner. In the illustrated embodiment, the divider walls 56 extend vertically over approximately one-half to two-thirds of the overall height of the container 10. Alternatively, the divider walls 56 may extend over a lesser height than that shown, provided that the walls 56 are of a height sufficient to maintain division and upright support of the products 15 stored within the container 10. It will be appreciated that fewer divider walls 56 or a greater number of divider walls 56 than that shown may be provided within the receptacle 12, depending on the size of the products to be stored therein.

Turning now to the container lid or cover 11, reference is made to FIGS. 3 and 9-13. The container lid 11 includes an elongated and generally planar top wall 60 having oppositely-facing upper and lower surfaces 61 and 62. The top wall 60 additionally includes laterally-spaced and substantially parallel longitudinal edges 63, and front and rear end edges 64 and 65 which are also spaced from, and substantially parallel to, one another. The front and rear end edges 64 and 65 extend transversely between and interconnect the longitudinal edges 63 and together therewith define a pair of corner-shaped areas 66 at both the front and rear areas of the container lid 11. The lower surface 62 of the top wall 60 defines therein a downwardly-opening channel or groove 67 which extends continuously along the outer periphery of the lower surface 62. The container lid 11 additionally includes a pair of side walls or flanges 70 which are mirror images of one another, and front and rear end walls or flanges 71 and 72. The side walls 70 are substantially parallel to one another and depend downwardly from the lower surface 62 of the top wall 60 adjacent the respective longitudinal edges 63 thereof. The front and rear end walls 71 and 72 are substantially parallel with one another and depend downwardly from the lower surface 62 adjacent the respective front and rear end edges 64 and 65. The groove 67 formed in the lower surface 62 extends therealong immediately adjacent to inner surfaces of the side walls 70 and the front and rear end walls 71 and 72.

The side walls 70 and the front end wall 71 of the container lid 11 have respective lower edges which together provide the container lid 11 with a lower edge 75 which extends continuously around the lower end of the container lid 11 along the side walls 70 and the front end wall 71. The lower edge 75 accordingly has a U-shape when viewed from above when the container lid 11 is in an inverted position as shown in FIGS. 9-13. The lower edge 75 has a curvature along side portions thereof which is undulating or scalloped and which is complementary to the curvature of the edge 37 of the container receptacle 12. As such, when the container lid 11 is in the closed position, the lower edge 75 of the container lid 11 seats atop the stepped edge 37 of the receptacle 12 in a form-fitting and substantially flush manner.

More specifically, and moving in a rear to front direction of the container lid 11, the side walls 70 of the container lid 11 each have a rearwardly-oriented lower edge portion 77 which forms a rear part of the lower edge 75. Each lower edge portion 77 is downwardly convex and has a curvature which complements the respective rear step portion 41 of the receptacle edge 37 so as to seat thereagainst in the closed position of the container lid 11. Similarly, the side walls 70 of the container lid 11 each have a lower edge portion 78 which forms a central part of the lower edge 75 and which smoothly adjoins the adjacent rear lower edge portion 77 thereof, and which central lower edge portion 78 then transitions into a front lower edge portion 79 of the lower edge 75. The central lower edge portions 78, in the closed position of the container lid 11, each seat against the corresponding central step portion 43 of the stepped edge 37 of the receptacle 12, and the front lower edge portions 79 each seat against the corresponding front step portion 45 of the stepped edge 27. With respect to the front and rear of the container lid 11 and the lower edge 75 thereof, the front end wall 71 has a substantially straight or linear lower edge portion 80 which seats on or against the front step portion 38 of the receptacle edge 37 and the rear end wall 72 has a straight or linear lower edge portion 82 which seats on or against the rear step portion 40 of the receptacle edge 37 in the closed position of the container lid 11.

The side walls 70 and the front and rear end walls 71 and 72 of the container lid 11 are each joined to the lower surface 62 of the top wall 60 slightly inwardly from the respective longitudinal and end edges 63-65 thereof, such that an overhang 83 is formed along the entire periphery of the top wall 60, a lower surface 84 of which is substantially coextensive with the lower surface 62 of the top wall 60. The overhang 83 functions to assist the user in manipulating the container lid 11 when opening of the container 10 is desired.

Figure 12:
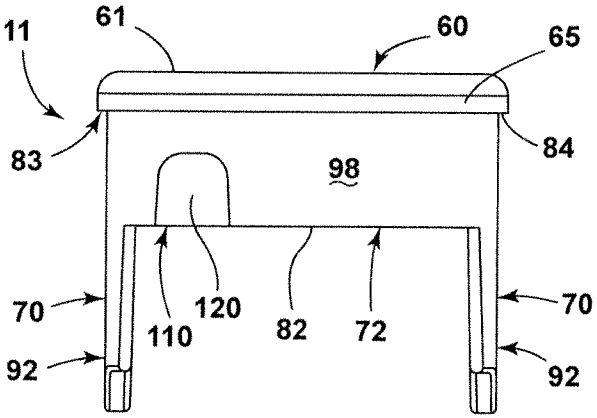
FIG. 12 is an enlarged rear view of the container lid of FIG. 9 in its normal upright use position.
Figure 9:
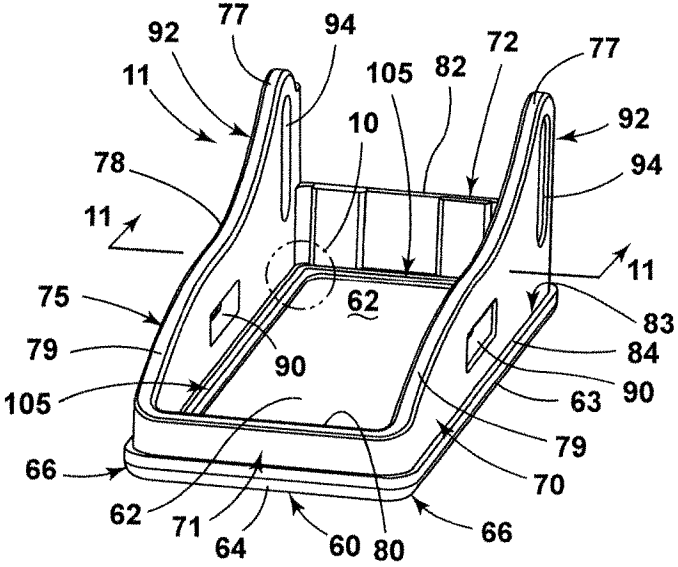
FIG. 9 is an enlarged perspective and isolated view of the underside of a container lid which forms an upper part of the container of FIG. 1.
Figure 11:
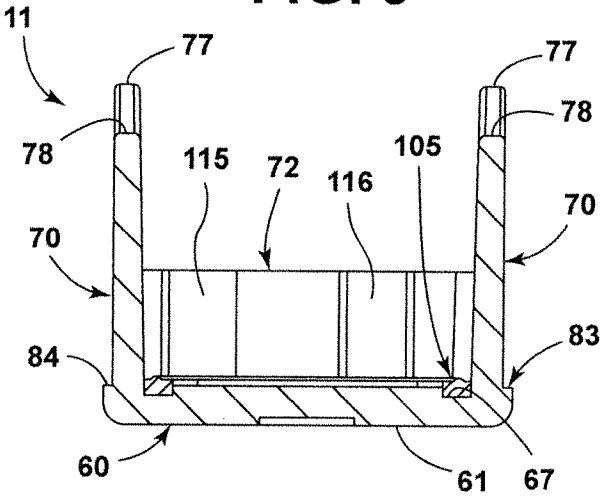
FIG. 11 is an enlarged cross-sectional view of the container lid taken generally along line 11-11 in FIG. 9.
Figure 14:
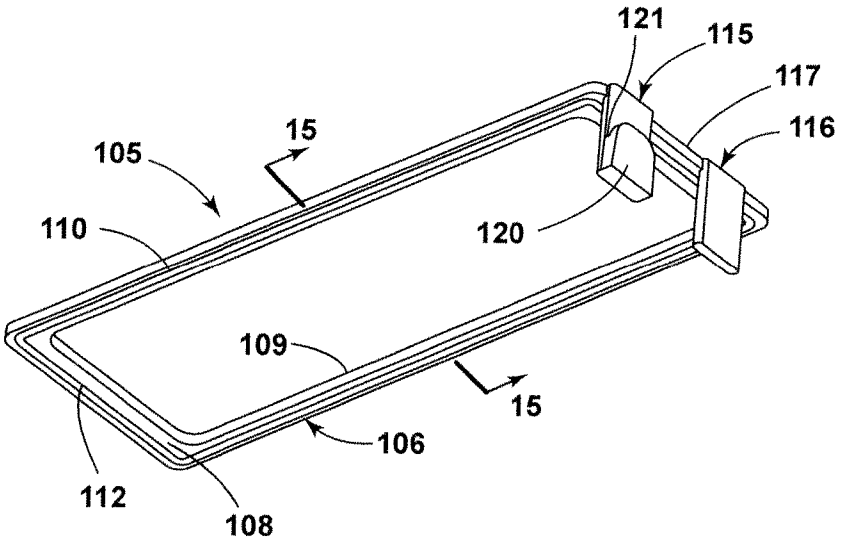
FIG. 14 is an enlarged perspective and isolated view of a lower side of a seal component of the container lid.
Figure 15:
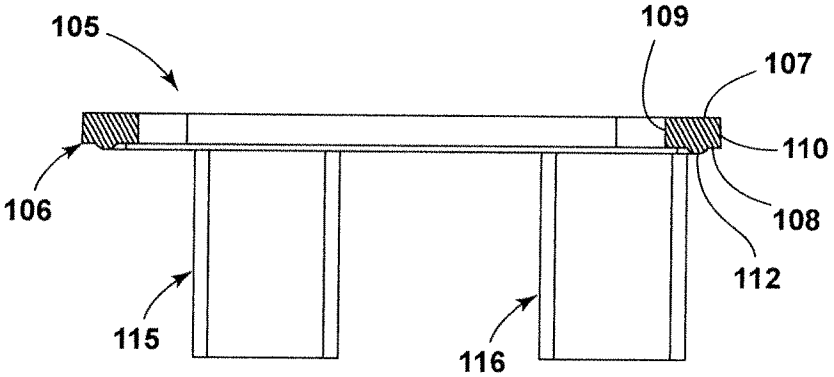
FIG. 15 is an enlarged cross-sectional view of the seal component as seen generally along line 15-15 in FIG. 14.

Each of the side walls 70 of the container lid 11 defines therein a horizontally-elongated opening or recess 90 which forms part of the child-resistant release mechanism. The opening or recess 90 may extend completely through the respective side wall 70 or through only a portion thereof (meaning that same is provided along the interior surface of the respective side wall 70 and opens inwardly) and is shaped to receive one of the detents 51 of the container receptacle 12 for the purpose of locking the container lid 11 in the closed position on the receptacle 12. Additionally, each side wall 70 has a rear portion or leg 92 on which the lower edge portion 77 of the edge 75 is formed, and an elongated recess or slot 94 is provided in each of these legs 92. In the normal upright position of the container 10 and with the container lid 11 in the closed position, the recesses or slots 94 are oriented substantially vertically. Each slot 94 at its opposite ends is rounded so as to be substantially semi-circular. Further, each of the legs 92 projects downwardly beyond the lower edge portion 82 of the rear end wall 72 of the container lid 11 such that the container lid 11, when viewed from the rear, has an inverted U-shaped configuration as best shown in FIG. 12. The legs 92 of the side walls 70 and the slots 94 form parts of the hinge arrangement 13 of the container 10.

Figure 13:
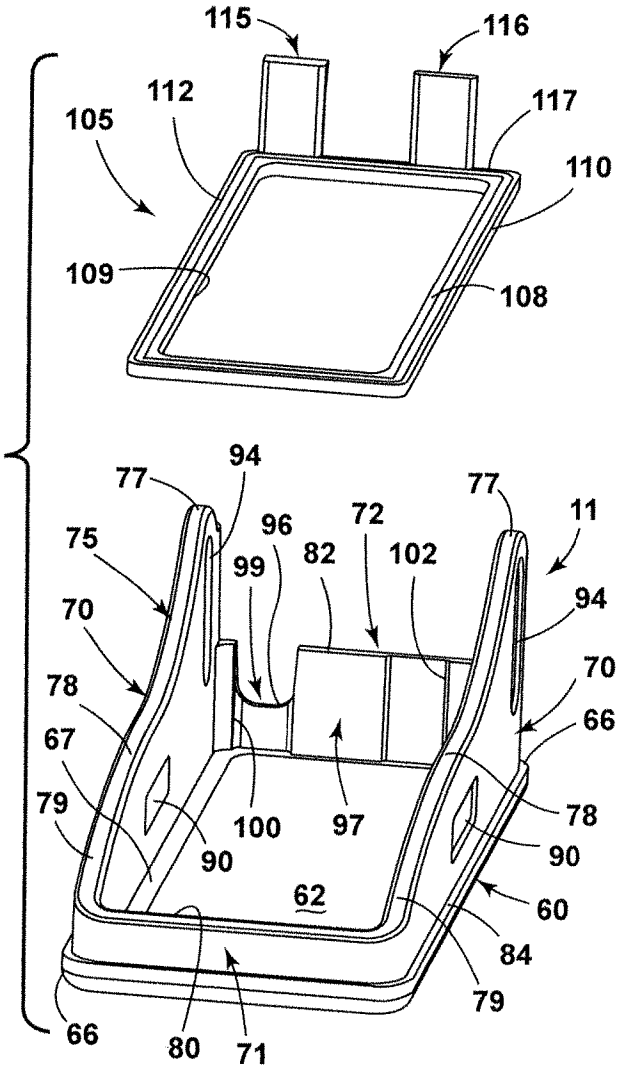
FIG. 13 is an enlarged exploded view of the container lid of FIG. 9.

Referring to FIGS. 9 and 11-13, the rear end wall or flange 72 of the container lid 11 has a vertical dimension which is greater than a vertical dimension of the front end wall or flange 71, and has oppositely-facing inner and outer surfaces 97 and 98. As best shown in FIG. 13, the rear end wall 72 includes a recess 99 which, in the normal upright position of the container 10, opens downwardly, and in the inverted position of the lid 11 shown in FIG. 13, opens upwardly. The recess 99 has an edge 96 which is defined by the end wall 72, and extends completely through the rear end wall 72 between the inner and outer surfaces 97 and 98 thereof and opens through the lower edge 82 of the end wall 72. The inner surface 97 of the rear end wall 72 is recessed or offset in a direction towards the outer surface 98 of the end wall 72 so as to form a substantially linear channel 100 which extends along the rear end wall 72 up to the inner or lower surface 62 of the top wall 60 of the container lid 11. Additionally, the inner surface 97 of the end wall 72 is offset in the direction of the outer surface 98 so as to form a further channel 102. The channel 102 is disposed in laterally spaced-apart relation with the channel 100 and is generally parallel thereto. The recess 99 and the channel 100 serve as a mold or injection gate, and the channel 102 serves as a mold well or dump as discussed further below. The channel 102 extends along the full vertical height of the end wall 72 between the lower edge 82 and the lower surface 62 of the top wall 60. Both channels 100 and 102 open inwardly towards the front end wall 71 of the container lid 11, and downwardly along the lower edge 82 of the rear end wall 72.

The container 10 additionally includes a gasket or seal component or member 105 which forms part of the container lid 11 and cooperates with the upper edge 33 of the container receptacle 12 to seal off the interior 14 of the container 10 and the product 15 disposed therein from the environment when the container lid 11 is in the closed position. The seal component 105 is generally elongated and rectangular in shape and has a rectangular ring-shaped base 106 which forms the main body of the seal component 105. The base 106 has oppositely-facing upper and lower surfaces 107 and 108, and oppositely-facing and generally vertically oriented inner and outer peripheral edge surfaces 109 and 110. Additionally, a bead 112 is provided on the lower surface 108 and projects downwardly therefrom. The bead 112 extends continuously around the entire periphery of the base 106. A pair of tabs 115 and 116 are disposed on a rear section 117 of the base 106 in sidewardly-spaced relation with one another and are cantilevered downwardly from the rear section 113 of the base 106 adjacent an outer edge thereof. The tab 115 at its outer free end incorporates a catch member 120 which defines a notch 121 which opens upwardly in the normal use position of the container 10.

In one embodiment, the seal component 105 and the container lid 11 are constructed as an integral component of the container 10, for example by over-molding. The seal component 105 in one embodiment is a thermoplastic elastomer (TPE), such as thermoplastic polyurethane (TPU). The container lid 11 (as well as the receptacle 12) is constructed of polypropylene, polyethylene, polystyrene, hemp resin, nylon, ABS or other suitable material. Over-molding the seal component 105 and the container lid 11 results in a chemical bond between these components. As mentioned above, the recess 99 and channel 100 serve as an injection gate for the seal material which is injected into the recess 99 and fills an area between the lower surface 62 of the top wall 60 of the container lid 11 and a corresponding opposed mold part, and the channel 102 serves as a mold well or mold dump. The tabs 115 and 116 of the seal component 105 are formed as a result of the seal material entering into the respective channels 100 and 102 of the container lid 11 during the over-molding process. Additionally, the catch member 120 of the tab 115 is formed during the molding process so that the catch member 120 wraps around the edge 96 of the recess 99 and as a result, the edge 96 engages within the notch 121 of the catch member 120. This engagement of the catch member 120 of the seal component 105 with the rear end wall 72 of the container lid 11 results in a mechanical connection between the seal component 105 and the container lid 11, which, in combination with the chemical bond discussed above helps to maintain the seal component 105 fixed to the container lid 11. Once the over-molding process is complete, the base 106 of the seal component 105 is located within the groove 67 of the top wall 60 of the container lid 11, and the bead 112 of the seal component 105 is oriented downwardly in the normal upright position of the container 10. As an alternative to the over-molding process described above, the seal component 105 may be formed as a separate component from the container lid 11 and then fixed thereto in a suitable manner.

The container lid 11 is installed to the container receptacle 12 by deflecting the rear legs 92 of the respective side walls 70 slightly outwardly to allow insertion of the pins 55 of the receptacle 12 into the respective slots 94. Once the pins 55 are fully engaged within the respective slots 94, the side walls 70 deflect back inwardly which serves to maintain the lid 11 fixed to the receptacle 12.

With the container lid 11 installed on the receptacle 12, the container 10 is usable for housing products 15 therein, and is openable to provide access to the products 15 and is closable to prevent such access as follows. In the closed position of the container 10 as shown in FIG. 1, the pins 55 of the lid 11 are initially positioned at the tops of their respective slots 94. Starting from the closed position of the container 10, in order to open the container 10, the user applies inward pressure to each of the side walls 18 at the respective actuation areas 50 thereof so that same are deflected inwardly and towards one another. This inward deflection of the side walls 18 at the areas 50 necessarily causes the detents 51 at the upper ends of the respective side walls 18 to deflect inwardly which releases the detents 51 from the respective slots 90 of the container lid 11. While maintaining inward pressure on the actuation areas 50 (to prevent the detents 51 from reengaging within the slots 90) the user then grasps the container lid 11 (for example, along the overhang 83 thereof) and pivots same upwardly and rearwardly away from the receptacle (in a counterclockwise direction with respect to FIGS. 1 and 3). This pivoting movement of the container lid 11 relative to the receptacle 12 gradually causes the pins 55 to change position within their respective slots 94. More specifically, the pins 55 during the opening movement are gradually repositioned in the slots 94 in a direction toward the opposite ends (or lower ends) of the slots 94 (as compared to their initial position when the lid 11 is closed). Continued pivoting movement of the lid 11 away from the receptacle 12 causes the lid 11 to reach its fully open position as shown in FIG. 3 so as to allow access to the interior 14 of the container 10. The product 15 can then be removed from the container 11 by grasping the upper end thereof. The elongated shape of the slots 94 and the orientation thereof in the rear end walls 72 of the container lid 11 allows same to be opened through an angle of approximately 110 degrees to allow access to all products 15 stored therein, and particularly to product 15 stored in the rear part of the interior 14 of the container 10, because the lid 11 in its open position does not interfere or block the open upper end of the receptacle 12.

The container 10 is closed in the reverse manner from that described above. Specifically, while grasping the receptacle 12 the user pivots the container lid 11 in a clockwise direction, which causes gradual repositioning of the pins 55 within their respective slots 94 in a direction toward their initial or upper positions. Continued pivoting movement of the container lid 11 towards the receptacle 12 eventually positions the slots 90 of the container lid 11 adjacent their respective detents 51. The bevels 52 of the respective detents 51 assist in closing the container 10 in that same cause a slight outward deflection of the side walls 70 as the lower edges thereof engage the respective bevels 52. Once these lower edges clear the respective surfaces 54 of the detents 51, the side walls 70 deflect back inwardly which effectively engages the detents 51 in their corresponding slots 90. With the detents 51 engaged within the respective slots 90, the edges of the respective side walls 70 which define the lowermost extents of the slots 90 are located underneath the surfaces 53 of the respective detents 51. In this regard, if the container lid 11 is pivoted away from the receptacle 12 without the user first pressing the actuation areas 50 of the side walls 18 inwardly, these edges of the respective side walls 70 will abut the surfaces 53 of the detents 51 and prevent opening of the container 10, which serves as a child-resistant mechanism.

With the container lid 11 fully closed as described above, the seal 105 is compressed between the top wall 60 of the container lid 11 and the upper end of the receptacle 12. More specifically, the bead 112 of the seal 105 is compressed against the upper edge 33 of the receptacle 12 around the entire periphery thereof which effectively seals off the interior 14 of the container 10 to prevent the escape of odors which may emanate from product stored therein, preserve the freshness thereof, and/or prevent the ingress of moisture, liquids and/or other contaminants into the interior 14.

Figure 15A:
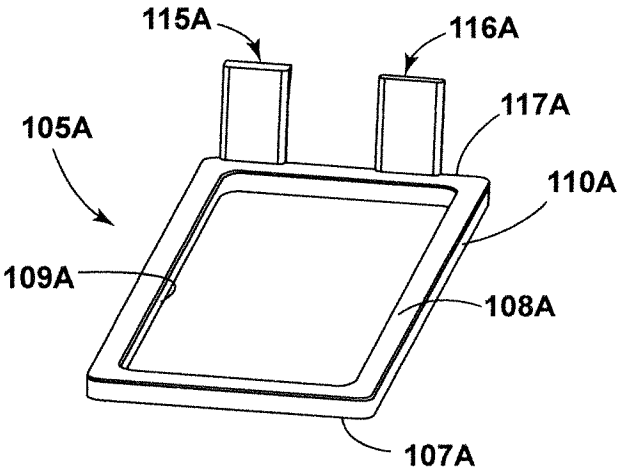
FIG. 15A is an enlarged view of a further embodiment of the seal component, which is similar the view of the seal component shown in FIG. 13.
Figure 15B:
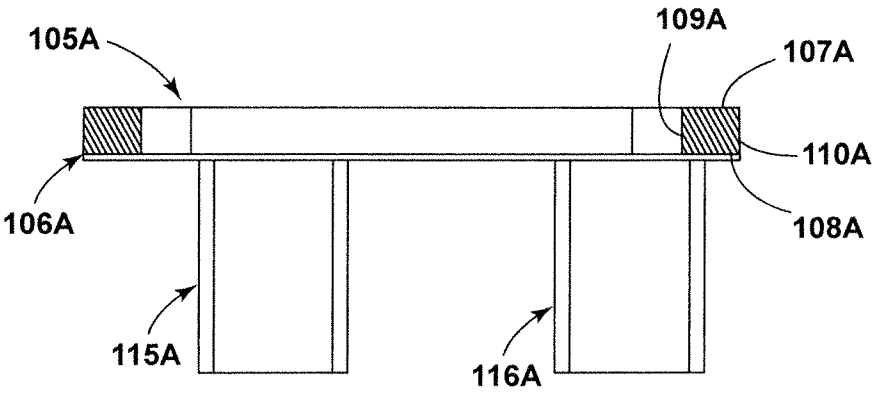
FIG. 15B is an enlarged cross-sectional view of the seal component of FIG. 15A, which view is similar to FIG. 15.
Figure 18:
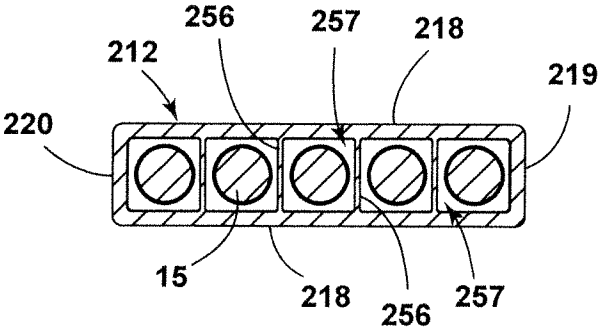
FIG. 18 is an enlarged cross-sectional view of the container of FIG. 16 taken generally along line 18-18 in FIG. 16.
Figure 19:
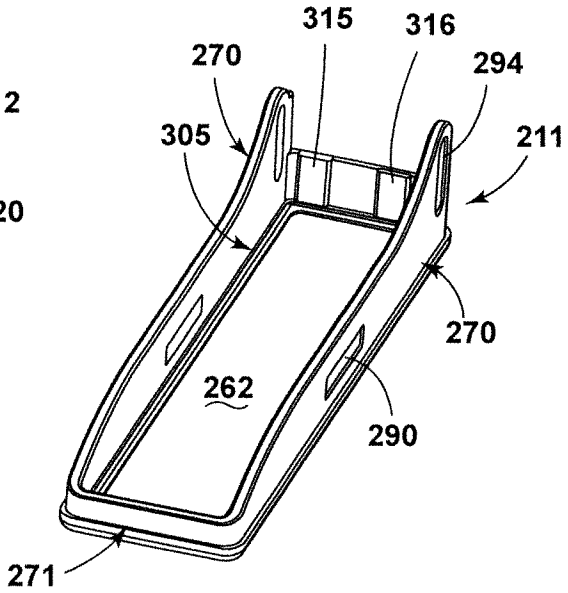
FIG. 19 is an enlarged perspective and isolated view of the underside of the container lid which forms an upper part of the container of FIG. 16.
Figure 17:
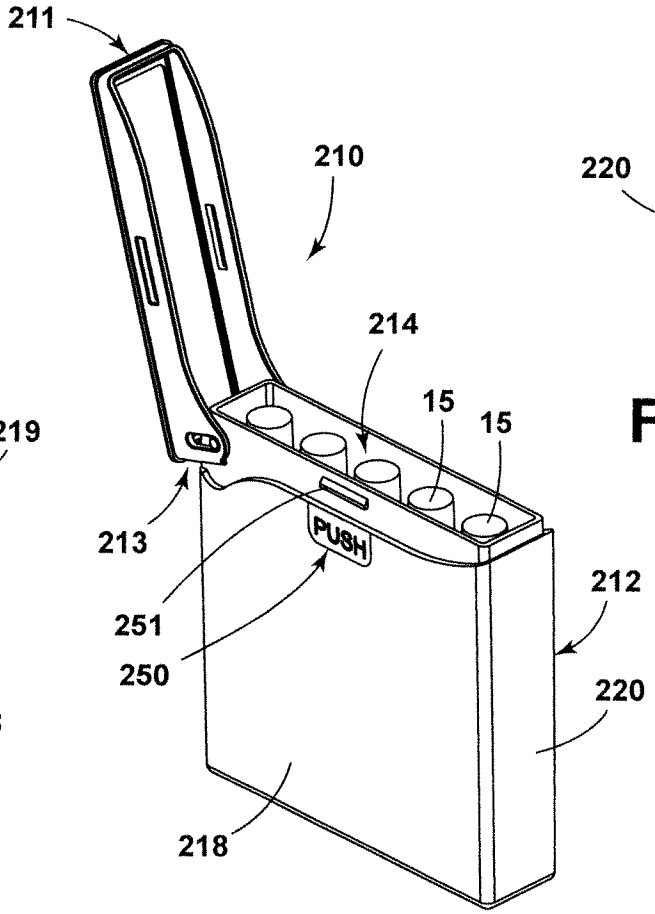
FIG. 17 illustrates the container of FIG. 16 in an open configuration.
Figure 16:
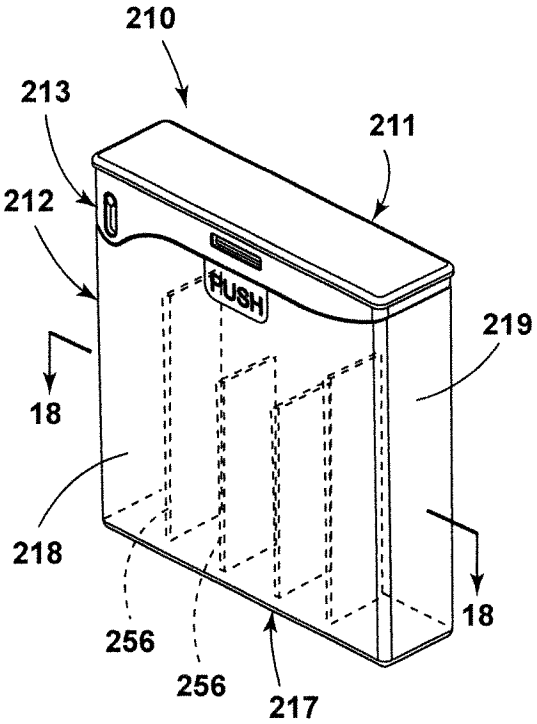
FIG. 16 is a side perspective view of a container according to a further embodiment of in a closed configuration.

FIGS. 15A and 15B illustrate an alternative embodiment of the seal component 105 described above. The seal component 105A of this embodiment is similar to the previously-described seal component 105, and the same reference numbers, plus an "A", will be utilized to depict features of the seal component 105A which are similar or identical to that of the seal component 105 and a detailed description of these components will accordingly not be provided. The seal component 105A of this embodiment forms part of the container lid 11 and cooperates with the upper edge 33 of the container receptacle 12 to seal off the interior 14 of the container 10, as does the prior embodiment. However, the seal component 105A does not include the bead 112, and the lower surface 108A is instead planar or flat along the entirety, or substantially the entirety, thereof. Additionally, the seal component 105A is slightly thicker than the seal component 105 in its overall height. The seal component 105A is otherwise identical to the seal component 105, and may be provided as an integral component of the container lid 11 or as a separate part therefrom as discussed above. When the container lid 11 is in the fully closed position, the seal 105A is compressed between the top wall 60 of the container lid 11 and the upper end of the receptacle 12. More specifically, the flat lower surface 108A of the seal component 105A is compressed against the upper edge 33 of the receptacle 12 around the entire periphery thereof which effectively seals off the interior of the container 10.

It will be appreciated that the slots 94 provided in the container lid 11 may not penetrate completely through the respective side walls 70 thereof as illustrated, and instead may be provided as sidewardly and inwardly-opening elongated recesses which open into the interior of the container lid 11 and in which the terminal ends of the pins or projections 55 respectively engage. As a further alternative, recesses may be provided on the upper rear portion of the receptacle 12 and pins or projections may be provided on the container lid 11. In this embodiment, in order to preserve the sealing function of the container 10, the recesses do not penetrate through the respective side walls 18 of the receptacle 12, and instead are provided as sidewardly and outwardly opening elongated recesses in which the pins are respectively engaged.

A further embodiment of the container is illustrated in FIGS. 16-19. This embodiment is highly similar to the prior embodiment, except that same is appropriately sized to store additional product 15. The same reference numbers, plus 200, are accordingly utilized as in the prior embodiment to depict the same or similar features, and a full description thereof will not be provided.

The container 210 of this embodiment includes four divider walls 256 which are positioned within the interior 214 of the container 210. Each divider wall 256 is generally planar and vertically oriented and extends between and adjoins inner opposed surfaces of the laterally-spaced side walls 218 of the receptacle 212, and each divider wall 256 is additionally joined to an inner and upwardly-facing surface of the bottom wall 217 of the receptacle 212. The divider walls 256 are positioned within the interior 214 of the container 210 so as to divide same into five compartments 257 of substantially equal size, each for storing a product 15 therein in an upright manner. In this embodiment, the two centrally-located divider walls 256 are shorter in height than the two outermost divider walls 256 which allows the side walls 218 of the receptacle 212 to flex inwardly when the actuation areas 250 are pressed in order to open the container 210.

Figure 20:
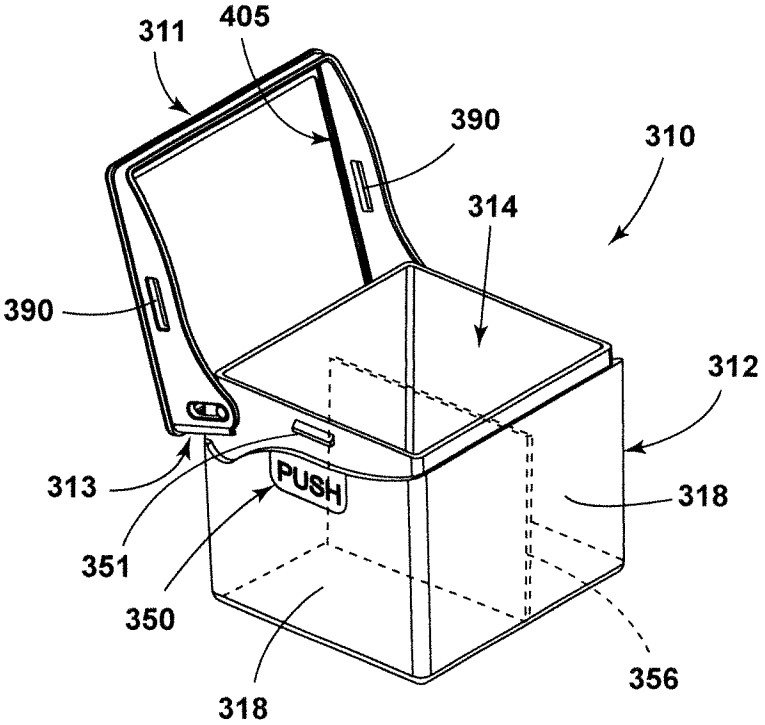
FIG. 20 is a side perspective view of a container according to a further embodiment.

FIG. 20 illustrates a further embodiment of a container 310 which is similar to the first embodiment, except that same is sized differently and is used to store small items. Such items may be marijuana edibles or pharmaceuticals, for example. The same reference numbers, plus 300, are accordingly utilized as in the first embodiment to depict the same or similar features, and a full description thereof will not be provided. The container 310 of this embodiment is depicted in an open configuration in FIG. 20, and includes a container lid 311 and a receptacle 312 connected to one another with a hinge arrangement 313 as in the prior embodiments. This embodiment of the container 310 is structured substantially identically to the first embodiment of the container 10, except that the container 310 is substantially square-shaped and includes four side walls 318 which are substantially identical in dimension with two of the side walls 318 being respectively oriented at the front and rear of the container 310 similar to the orientation of the front and rear end walls 19 and 20 of the first embodiment.

If it is desirable to have small objects or items stored and separated from one another by type, color, etc., then the container 310 may include one or more divider walls 356 oriented in an upright manner within the receptacle 312 as shown in dotted lines in FIG. 20. The divider wall 356 extends vertically through only part of the height of the container 310 so as to avoid interfering with the needed flexibility of the side walls 318 of the container 310 when the actuation areas 350 are pressed by the user to open the container 310.

It will be appreciated that the container 310 may alternatively not include the divider wall 356, for example if only one type of object is to be stored within the container 310. Alternatively, the container 310 may be provided with more than one divider wall 356 if more than two types of objects are to be stored.

Although particular preferred embodiments of the container have been disclosed in detail for illustrative purposes, it will be recognized that variations or modifications of the disclosed container, including the rearrangement of parts, lie within the scope of the invention.

What is claimed is:

1. The container comprising:

a lid member;

a receptacle member including a base wall and a side wall joined to and projecting outwardly from said base wall, said base wall and said side wall together defining at least part of a hollow interior of said container which opens through an edge portion of said side wall;

a hinge arrangement interconnecting said lid member to said receptacle member for movement between an open position in which said hollow interior is accessible and a closed position in which said hollow interior is inaccessible, said hinge arrangement including at least one elongated recess disposed on one of said receptacle member or said lid member and at least one projection disposed on the other of said receptacle member or said lid member, said projection being engaged within said recess and slidably movable relative to and along said recess during opening and closing of said lid member;

a container-locking arrangement disposed to cooperate between said receptacle member and said lid member, said container-locking arrangement having a locked condition in which said lid member is maintained in said closed position thereof to prevent access to said hollow interior, and an unlocked condition in which said lid member is movable into said open position to permit access to objects stored within said hollow interior, said container-locking arrangement comprising a locking recess disposed on one of said lid member or said receptacle member and a locking detent disposed on the other of said receptacle member or said lid member and configured to engage within said locking recess in said closed position of said lid member, said container-locking arrangement further comprising an actuation portion disposed on said side wall of said receptacle member, said actuation portion when actuated causing release of said locking detent from said locking recess to permit movement of said lid member from said closed position to said open position, said actuation portion comprising a deflectable side wall portion disposed adjacent said locking recess or said locking detent and inward deflection of said deflectable side wall portion releases said locking detent from said locking recess; and a seal component comprising a compressible material, said seal component being fixed to said lid member and configured to compressively engage said edge portion of said receptacle member in said closed position of said lid member to seal said hollow interior and prevent ingress of contaminants into said hollow interior and prevent egress of odors emanating from product stored in said container.

2. The container of claim 1, wherein said edge portion of said receptacle member extends peripherally along an entire upper extent of said receptacle member and said seal component extends along said entire upper extent of said receptacle member.

3. The container of claim 1, wherein said side wall of said receptacle member includes a pair of laterally-spaced side walls and a pair of laterally-spaced end walls, said side walls being joined to and projecting upwardly from respective opposite first edge portions of said base wall and said end walls being joined to and projecting upwardly from respective opposite second edge portions of said base wall, said side walls, said end walls and said base wall together defining said part of said hollow interior of said container, said side walls being disposed substantially parallel to one another and said end walls being disposed transversely relative to said side walls and substantially parallel to one another to provide said container with a rectangular shape.

4. The container of claim 3, wherein said lid member includes a top wall and a pair of side walls joined to and projecting downwardly from respective opposite edge portions of said top wall, each said side wall of said lid member having portions disposed in superimposed relation with respective upper edge regions of the respective said side walls of said receptacle member in said closed position of said lid member.

5. A container comprising:

a lid member;

a receptacle member including a base wall and a side wall joined to and projecting outwardly from said base wall, said base wall and said side wall together defining at least part of a hollow interior of said container which opens through an edge portion of said side wall, said side wall of said receptacle member including a pair of laterally-spaced side walls and a pair of laterally-spaced end walls, said side walls being joined to and projecting upwardly from respective opposite first edge portions of said base wall and said end walls being joined to and projecting upwardly from respective opposite second edge portions of said base wall, said side walls, said end walls and said base wall together defining said part of said hollow interior of said container;

a hinge arrangement interconnecting said lid member to said receptacle member for movement between an open position in which said hollow interior is accessible and a closed position in which said hollow interior is inaccessible, said hinge arrangement including at least one elongated recess disposed on one of said receptacle member or said lid member and at least one projection disposed on the other of said receptacle member or said lid member, said projection being engaged within said recess and slidably movable relative to and along said recess during opening and closing of said lid member;

a container-locking arrangement disposed to cooperate between said receptacle member and said lid member, said container-locking arrangement having a locked condition in which said lid member is maintained in said closed position thereof to prevent access to said hollow interior, and an unlocked condition in which said lid member is movable into said open position to permit access to objects stored within said hollow interior, said container-locking arrangement including a locking recess disposed on one of said lid member or said receptacle member and a locking detent disposed on the other of said receptacle member or said lid member and configured to engage within said locking recess in said closed position of said lid member, said side walls of said receptacle member each comprising an actuation area configured for deflection inwardly towards said hollow interior of said container to cause release of said locking detent from said locking recess and permit movement of said lid member from said closed position to said open position; and a seal component comprising a compressible material, said seal component being fixed to said lid member and configured to compressively engage said edge portion of said receptacle member in said closed position of said lid member to seal said hollow interior and prevent ingress of contaminants into said hollow interior and prevent egress of odors emanating from product stored in said container.

6. A container comprising:

a lid member including a top wall and a pair of side walls joined to and projecting downwardly from respective opposite edge portions of said top wall;

a receptacle member including a base wall and a side wall joined to and projecting outwardly from said base wall, said base wall and said side wall together defining at least part of a hollow interior of said container which opens through an edge portion of said side wall;

a hinge arrangement interconnecting said lid member to said receptacle member for movement between an open position in which said hollow interior is accessible and a closed position in which said hollow interior is inaccessible, said hinge arrangement including at least one elongated recess disposed on one of said receptacle member or said lid member and at least one projection disposed on the other of said receptacle member or said lid member, said projection being engaged within said recess and slidably movable relative to and along said recess during opening and closing of said lid member;

a container-locking arrangement disposed to cooperate between said receptacle member and said lid member, said container-locking arrangement having a locked condition in which said lid member is maintained in said closed position thereof to prevent access to said hollow interior, and an unlocked condition in which said lid member is movable into said open position to permit access to objects stored within said hollow interior; and a seal component comprising a compressible material, said seal component being fixed to said lid member and configured to compressively engage said edge portion of said receptacle member in said closed position of said lid member to seal said hollow interior and prevent ingress of contaminants into said hollow interior and prevent egress of odors emanating from product stored in said container, said top wall having a lower surface facing said hollow interior of said container in said closed position of said lid member and said seal component being disposed immediately adjacent said lower surface of said top wall and between said side walls thereof.

7. The container of claim 6, wherein each said side wall of said lid member has a portion disposed in superimposed relation with respective upper edge regions of said side wall of said receptacle member in said closed position of said lid member.

8. The container of claim 7, wherein said at least one elongated recess of said hinge arrangement includes two elongated recesses, each recess being disposed in said portion of one of said side walls of said lid member, said at least one projection includes two projections, each projection being disposed adjacent one of said upper edge regions of said side wall of said receptacle member, each said projection being engaged within and slidably movable relative to and along said recess located in the adjacent said side wall of said lid member during opening and closing thereof.

9. The container of claim 6, wherein said container-locking arrangement includes a locking recess disposed on one of said lid member or said receptacle member and a locking detent disposed on the other of said receptacle member or said lid member and being engaged within said locking recess in said closed position of said lid member, said container further comprising an actuation portion configured for deflection by a user to cause release of said locking detent from said locking recess and permit movement of said lid member from said closed position to said open position.

10. The container comprising:

a lid member including a top wall and a pair of side walls joined to and projecting outwardly from respective opposite edge portions of said top wall;

a receptacle member including a base wall and a side wall joined to and projecting outwardly from said base wall, said base wall and said side wall together defining at least part of a hollow interior of said container which opens through an edge portion of said side wall;

a hinge arrangement interconnecting said lid member to said receptacle member for movement between an open position in which said hollow interior is accessible and a closed position in which said hollow interior is inaccessible, said hinge arrangement including at least one elongated recess disposed on one of said receptacle member or said lid member and at least one projection disposed on the other of said receptacle member or said lid member, said projection being engaged within said recess and slidably movable relative to and along said recess during opening and closing of said lid member;

a container-locking arrangement disposed to cooperate between said receptacle member and said lid member, said container-locking arrangement having a locked condition in which said lid member is maintained in said closed position thereof to prevent access to said hollow interior, and an unlocked condition in which said lid member is movable into said open position to permit access to objects stored within said hollow interior; and a seal component comprising a compressible material, said seal component being fixed to said lid member and configured to compressively engage said edge portion of said receptacle member in said closed position of said lid member to seal said hollow interior and prevent ingress of contaminants into said hollow interior and prevent egress of odors emanating from product stored in said container, said seal component comprising a main seal body configured as a closed loop and defining an opening therein, said top wall having a lower surface facing said hollow interior of said container in said closed position of said lid member, said main seal body being fixed to and extending along a periphery of said lower surface of said top wall between said side walls thereof, said main seal body having a sealing surface extending along an entirety thereof, said sealing surface being disposed in facing relation with said hollow interior of said container in said closed position of said lid member and being compressed between said edge portion of said receptacle member and said top wall of said lid member in said closed position thereof.

11. The container of claim 10, wherein said edge portion of said receptacle member is a terminal free edge portion and extends peripherally around an entirety of an upper end of said receptacle member, said part of said hollow interior of said container opening upwardly through said terminal free edge portion, and said sealing surface extends along an entirety of said terminal free edge portion of said receptacle member in said closed position of said lid member.

12. The container of claim 1, further comprising at least one divider wall disposed within said part of said hollow interior of said container within said receptacle member, said divider wall being disposed transversely between opposed portions of said side wall of said receptacle member to divide said part of said hollow interior into at least two interior compartments for separating products stored in said container from one another.

13. The container of claim 1, wherein said hinge arrangement is configured to permit pivoting movement of said lid member relative to said receptacle member between said open position and said closed position.

14. The container of claim 6, wherein said seal component is configured as a closed loop and has a sealing surface disposed in facing relation with said hollow interior of said container in said closed position of said lid member, said sealing surface being in direct contact with said edge portion of said receptacle member in said closed position of said lid member.

15. A container for sealing and storing objects therein, said container comprising:

a lid member having a top wall and a side wall structure depending downwardly from a periphery of said top wall, said top wall and said side wall structure together defining a downwardly-opening interior of said lid member;

a receptacle member having a base wall and a side wall structure projecting upwardly from a periphery of said base wall, said base wall and said side wall structure of said receptacle member together defining an upwardly-opening interior of said receptacle member which opens through an upper free edge portion of said side wall structure of said receptacle member;

said lid member being connected to said receptacle member for pivoting movement of said lid member between an open position in which said interior of said receptacle member is accessible and a closed position in which said lid member closes off said interior of said receptacle member;

a locking mechanism disposed to cooperate between said receptacle member and said lid member, said locking mechanism having a locked condition in which said lid member is maintained in said closed position thereof to prevent access to product stored in said interior of said receptacle member, and an unlocked condition in which said lid member is movable into said open position to permit access to product stored within said interior of said receptacle member, said locking mechanism comprising at least one deflectable area disposed on said side wall structure of said receptacle member which when deflected causes release of said locking mechanism from said locked condition to permit movement of said lid member into said open position; and a seal component comprising a compressible material, said seal component being fixedly disposed within said interior of said lid member and extending around an inner periphery of a lower surface of said top wall and being at least partially surrounded by said side wall structure of said lid member, said seal component being compressively engaged between said upper free edge portion of said receptacle member and said lid member in said closed position thereof and having a sealing surface portion in direct contact with said upper free edge portion of said receptacle member in said closed position of said lid member.

16. The container of claim 15, wherein said seal component has a closed loop structure and extends around an entirety of said inner periphery of said lower surface of said top wall.

17. The container of claim 15, wherein said at least one deflectable area comprises a pair of deflectable areas disposed on opposed and laterally-spaced apart portions of said side wall structure of said receptacle member, and deflection of said deflectable areas inwardly towards one another causes release of said locking mechanism from said locked condition.

18. The container of claim 15, further comprising a hinge arrangement interconnecting said lid member to said receptacle member, said hinge arrangement including at least one elongated recess disposed on one of said receptacle member or said lid member and at least one projection disposed on the other of said receptacle member or said lid member, said projection being engaged within said recess and slidably movable relative to and along said recess during opening and closing of said lid member.

* * * * *